US007841134B2

(12) United States Patent
Verry

(10) Patent No.: US 7,841,134 B2
(45) Date of Patent: Nov. 30, 2010

(54) INSULATOR CONSTRUCTION FOR PULL DOWN STAIRS

(76) Inventor: George H. Verry, 179 Munroe St., Pembroke, MA (US) 02359

( * ) Notice: Subject to any disclaimer, the term of this patent is extended or adjusted under 35 U.S.C. 154(b) by 471 days.

(21) Appl. No.: 11/893,283

(22) Filed: Aug. 15, 2007

(65) Prior Publication Data

US 2007/0283651 A1 Dec. 13, 2007

Related U.S. Application Data

(63) Continuation-in-part of application No. 10/779,495, filed on Feb. 17, 2004, now abandoned.

(51) Int. Cl.
*E04D 13/16* (2006.01)

(52) U.S. Cl. ..... 52/19; 52/202; 135/128

(58) Field of Classification Search ..... 52/19, 52/64, 66, 202; 135/128, 120.3, 156, 143, 135/115, 154; 182/46, 47; 150/165
See application file for complete search history.

(56) References Cited

U.S. PATENT DOCUMENTS 3,244,186 A * 4/1966 Thomason et al. ..... 135/100
3,441,037 A * 4/1969 Transeau ..... 135/97
3,472,252 A * 10/1969 Siebring ..... 135/128
4,706,551 A * 11/1987 Schofield ..... 454/66
4,798,019 A * 1/1989 Sury et al. ..... 43/1
4,938,523 A * 7/1990 Camp ..... 296/159
5,069,623 A * 12/1991 Peat ..... 434/260
5,215,109 A * 6/1993 Kent, Jr. ..... 135/137
5,377,711 A * 1/1995 Mueller ..... 135/87
6,170,503 B1 * 1/2001 Lin Shy ..... 135/119
6,701,948 B2 * 3/2004 Jopp et al. ..... 135/97

* cited by examiner

*Primary Examiner*—Brian E Glessner
*Assistant Examiner*—Christine T Cajilig
(74) *Attorney, Agent, or Firm*—Paul J. Cook

(57) ABSTRACT

An insulating construction. The construction is formed from a blank construction having a square or rectangular central portion and a side section attached to each side of the central portion. Two wing sections are attached to each of two opposing side sections. The wing sections are attachable to an adjacent side section free of a wing section. Then the blank construction is folded in a three dimensional configuration, it supported by a rod construction.

4 Claims, 8 Drawing Sheets

INSULATOR CONSTRUCTION FOR PULL DOWN STAIRS

REFERENCE TO RELATED APPLICATION

This application is a continuation-in-part of application Ser. No. 10/779,495, filed Feb. 17, 2004, now abandoned.

BACKGROUND OF THE INVENTION

At the present time, it is common practice to store a set of movable stairs in the ceiling of a top floor of a building. This ceiling commonly also forms the floor of the attic portion of the building.

The stairs generally are formed of joined hinge sections which permit them to be folded into a length shorter than the length of the stairs, when extended to their full length in a manner well known in the art. By reducing the length of the stairs when stored, the hole in the ceiling into which the stairs fit is conveniently reduced. The stairs, when extended, provide a convenient means for a person to travel between the top floor of the building and the attic of the building. The stairs are extended by pulling on a lead such as a rope end attached to the stairs to extend springs attached to the stairs in a manner well known in the art. The stairs are folded by compressing the springs.

Since the set of stairs are stored within a hole in the ceiling of the top floor of the building, heat energy is easily passed between the top floor and the attic through the hole. This transfer of energy is undesirable both during the time the top floor is heated or is cooled such as by air-conditioning.

Accordingly, it would be desirable to provide a means for preventing transfer of energy between the top floor and attic of a building. In addition, it would be desirable to provide such a means for preventing energy transfer which does not interfere with the desired operation and function of the stairs.

SUMMARY OF THE INVENTION

The present invention provides an insulator construction for heat energy which is structured to be positioned over an opening in a ceiling wherein the opening is designed to store a set of folding stairs. The present invention includes a foldable flexible insulating layer and a set of rods that form a rod structure which supports the insulating layer in a three dimensional configuration. Sections of the rods are removable from the rod structure so that the insulating structure of this invention can be folded for each storage. The insulating layer is formed from a blank sized to form a three dimensional structure which covers the hole in a ceiling which also comprises a floor for an attic. The insulating layer extends a short distance above the hole to effect separation of air in the attic from air in a building floor adjacent to and below the attic.

The blank construction includes a central square or rectangular portion. Four side sections attached to the central portion and four wing sections wherein two wing sections are each attached to two opposing side sections. The three dimensional insulating layer is formed by folding the blank construction and providing a rod construction to support the insulation layer in its three dimensional configuration. Sections of the rods are removable from the rod structure so that the insulating structure of this invention can be folded for each storage. The insulating layer is formed from a blank sized to form a three dimensional structure which covers the hole in a ceiling which also comprises a floor for an attic. The insulating layer extends a short distance above the hole to effect separation of air in the attic from air in a building floor adjacent to and below the attic.

The blank construction includes a central square or rectangular portion. Four side sections attached to the central portion and four wing sections wherein two wing sections are each attached to two opposing side sections. The three dimensional insulating layer is formed by folding the blank construction and providing a rod construction to support the insulation layer in its three dimensional configuration. When the insulation layer is folded, the wing sections are attached to a peripheral portion of the two side sections free of wings to form a skirt that extends about the periphery of the insulating layer. A rod structure supports the insulating layer in its three dimensional configuration.

DESCRIPTION OF SPECIFIC EMBODIMENTS

The present invention provides an insulator construction which can be easily stored prior to use, can be easily positioned within a desired volume of use and which can be easily removed from the volume of use. The blank for the insulator construction can be formed from a single piece having scores which define a central portion having four side sections extending from the central portion and four wing sections wherein two wing sections are attached to each of two opposing side sections. The central portion preferably comprises a square or rectangle shape.

When the blank is folded in a three dimensional configuration, the wing sections are joined to a peripheral portion of two adjacent side sections that are free of wing sections by any conventional means such as with an adhesive mechanically such as with hooks that fit into an eye attached to the wing sections or by polymeric hooks on one wing section which are attached to polymeric fibers on the periphery of adjacent side sections which is an attachment system known as Velcro or the like. It is preferred to utilize a means for joining the wing section to the periphery of the adjacent side sections which can be detached without damaging the insulator construction such as with a Velcro system.

The flexible insulating layer can be formed from any suitable material having mechanical strength and which renders the insulator construction portable such as plastic, sheet metal or the like. The insulator layer can be formed of any conventional heat insulating material such as fiberglass, polymeric fibers, polymeric foam, fiber board, mineral fiber or the like positioned between two heat reflecting players can be formed of any suitable material such as a metal sheet including aluminum, sheet metal or the like or a metalized plastic layer or the like. The layers are joined together by any conventional means such as with an adhesive. The heat reflecting layer improves the heat insulating capacity of the insulator construction provides the vapor barrier and provides a convenient means for retaining the insulators in place.

Figure 8:
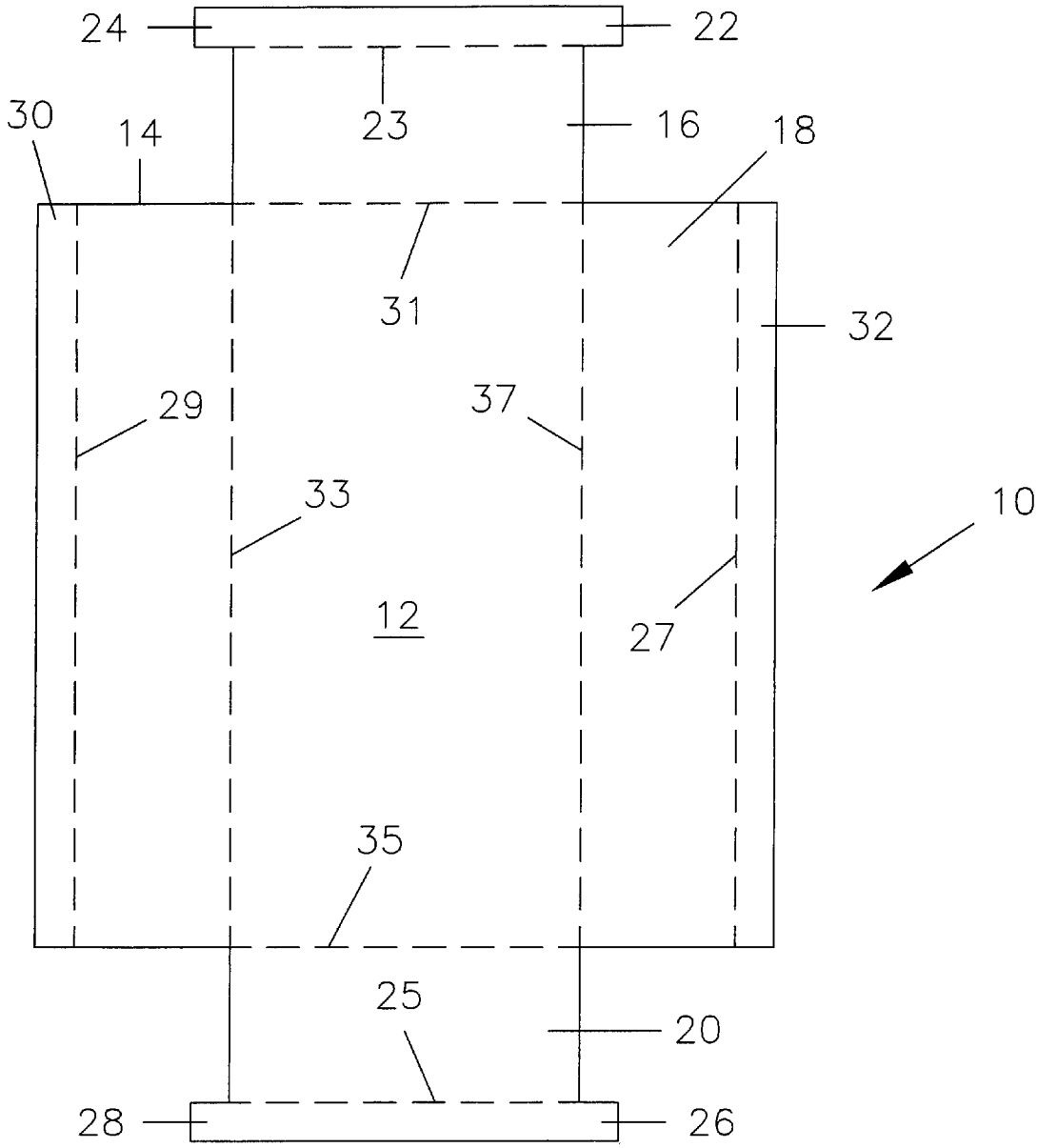
FIG. 8 is a top view of a blank of the insulating layer of this invention.

Referring to FIGS. 1, 2, 3, 4 and 8, the blank construction for the insulating layer of this invention 10 includes a central portion 12, which is shown as rectangular and four side sections 14, 16, 18 and 20. Two wing sections 22 and 24 are attached to side section 16 and include either a hook containing strip or a fiber containing strip of a Velcro attachment system. The strip is attachable to a complementary hook or fiber strip on the outer surfaces 30 and 32 defined by score lines 27 and 29 of side sections 14 and 18. The wing sections 26 and 28 attached to side section 20 also include either a hook containing strip or a fiber containing strip of a Velcro attachment system. The strips are attachable to a complementary hook or fiber strip on the outer surfaces 30 and 32 of side sections 20 and 18. Alternatively self stick tapes, straps or interlocking flanges can be utilized as the connection system. When the wing sections 22, 24, 26 and 28 defined by score lines 23 and 25 are attached to surfaces 30 and 32, the insulator construction of this invention is formed as shown in FIGS. 1, 2, 3 and 4. The surfaces 30 and 32 and the wing sections 22, 24, 26 and 28 form a skirt 36, typically about 3 inches wide, which extends about the entire periphery of the insulating construction 11 of this invention. The top of the three dimensional constructions of this invention is defined by score lines 31, 33, 35 and 37. (FIG. 8).

As shown in FIGS. 1, 2, 3 and 4, the insulating layer is held in place by a rod construction including rod 40 which is detachable connected to joints 42 and 44 which, in turn are detachable connected to rods 41 and 46. Rods 41 and 46 are detachably connected to joints 43 and 45 which, in turn are connected to rods 48 and 51 which, in turn are detachably connected to joints 50 and 52. Joints 50 and 52 are detachable connected to rod 54.

Figure 1:
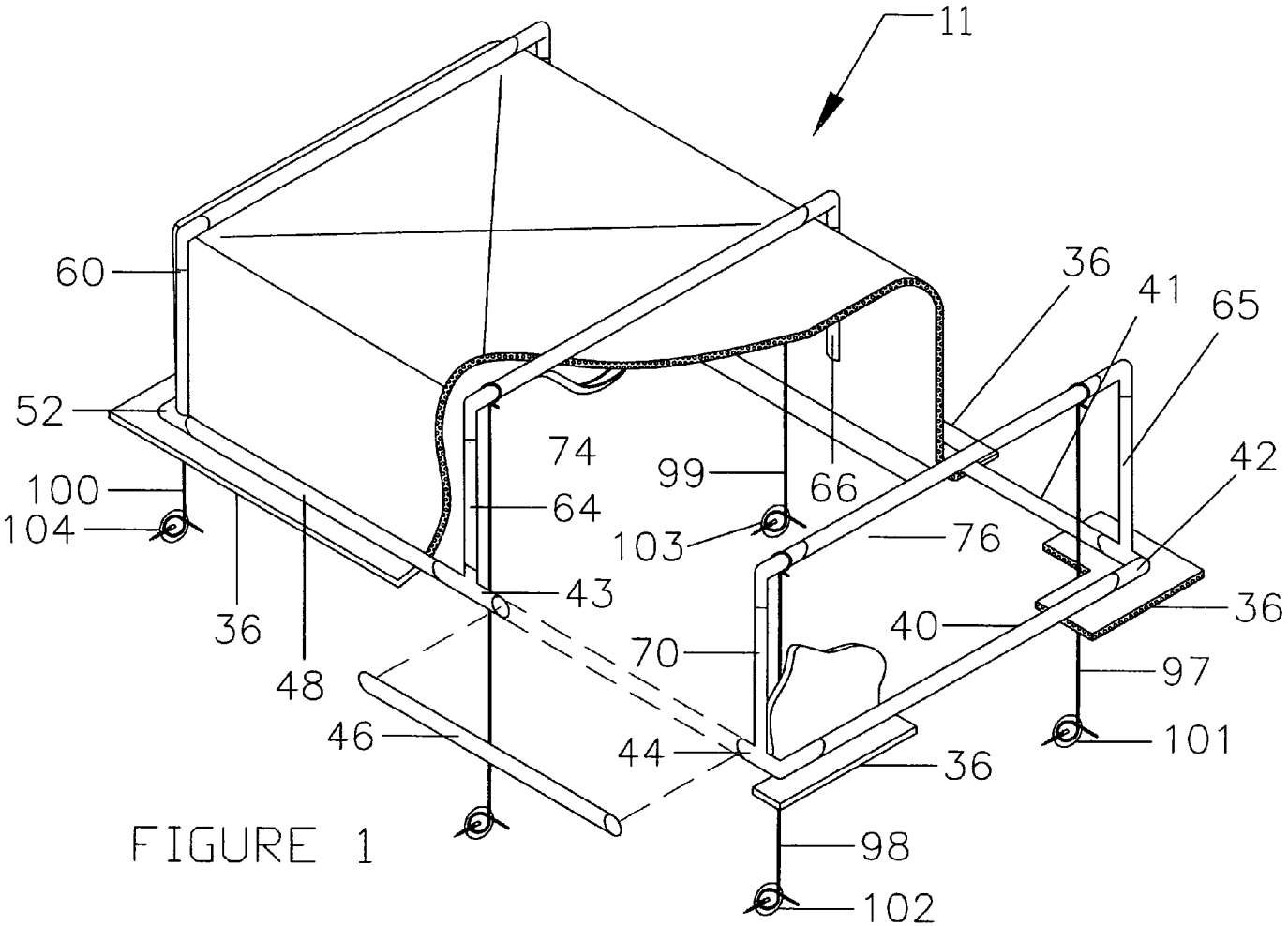
FIG. 1 is a partial perspective view of the insulation construction of this invention.
Figure 2:
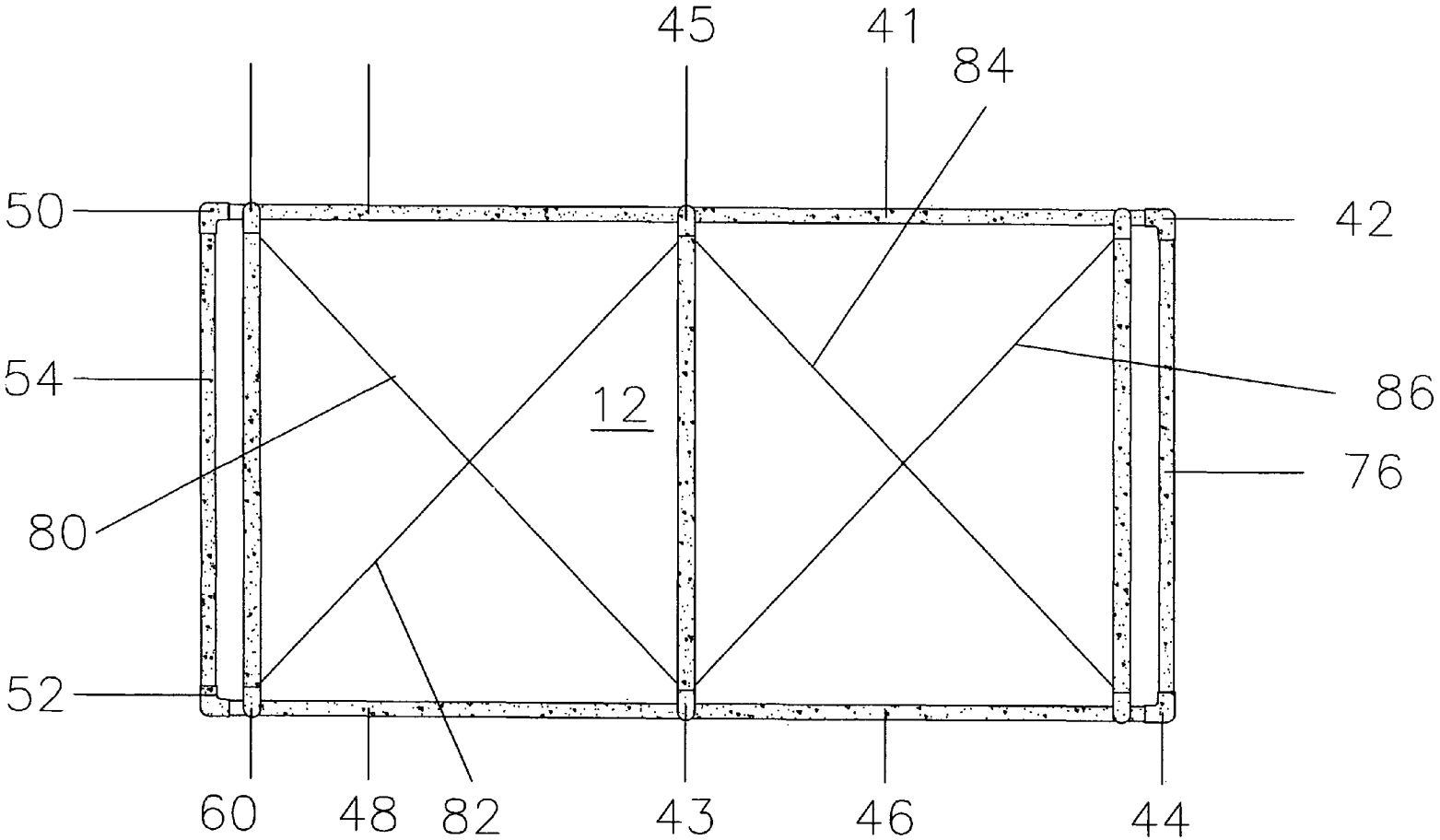
FIG. 2 is a top view of the insulation construction of FIG. 1.
Figure 3:
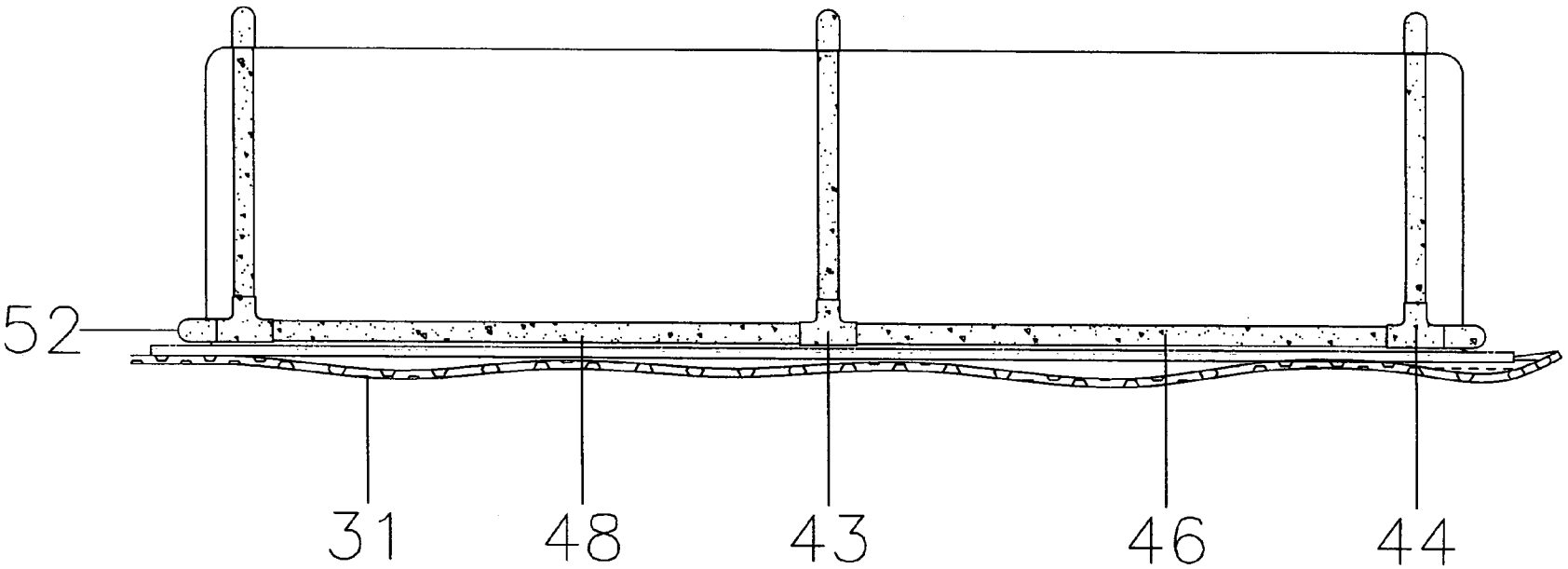
FIG. 3 is a side view of the insulating construction of FIG. 1.
Figure 5:
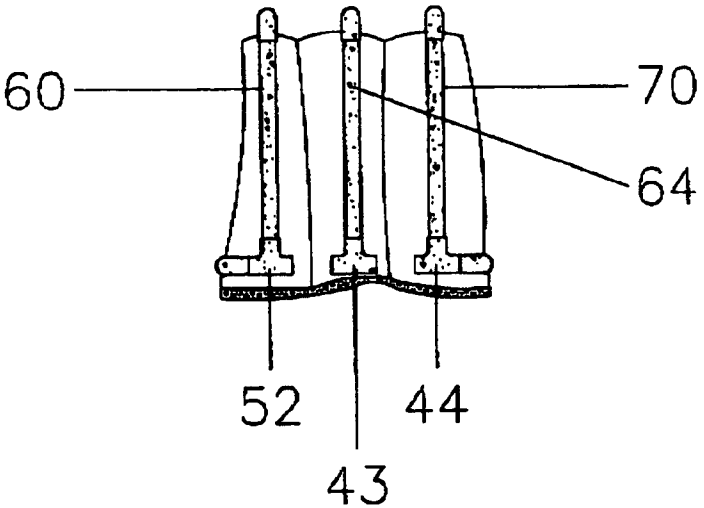
FIG. 5 is an end view of the insulating construction of FIG. 1 when folded.
Figure 4:
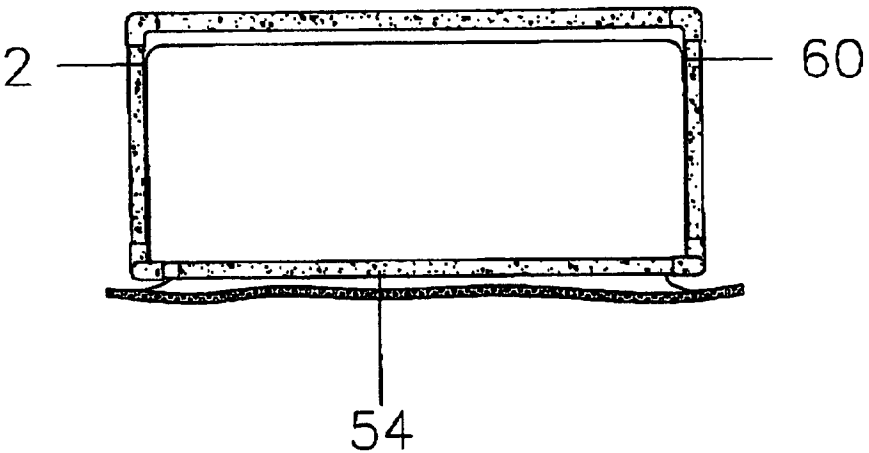
FIG. 4 is an end view of the insulating layer of FIG. 1.
Figure 6:
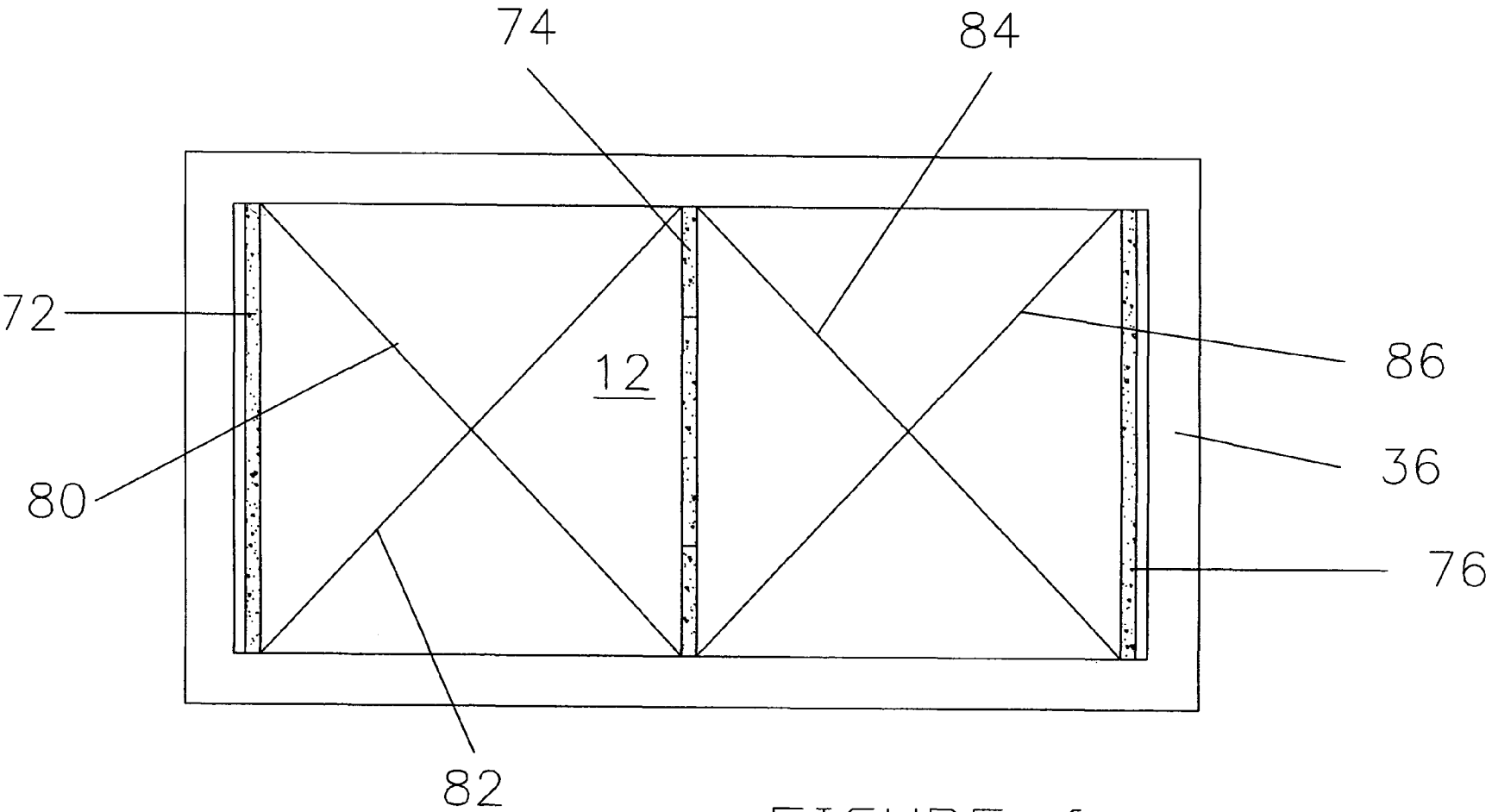
FIG. 6 is a bottom view of the insulating construction of FIG. 1.

Joints 50 and 52 are connected to vertical rods 60 and 62. Joints 43 and 45 are connected to vertical rods 64 and 66. Joints 43 and 45 are connected to vertical rods 64 and 66. Joints 42 and 42 are connected to vertical rods 65 and 70. Vertical rods 60 and 62 are connected to horizontal rod 72 (FIG. 6). Vertical rods 64 and 66 are connected to horizontal rod 74 (FIG. 6). Vertical rods 65 and 70 are connected to horizontal rod 76 (FIG. 6). As shown, for example in FIG. 5, the vertical rods extend through the insulating layer at two points so that horizontal rods 72, 74 and 76 support the insulating layer in its three dimensional configuration. When rods 41, 46, 48 and 51 are detached from their connecting joints, the apparatus of this invention can be compressed to the configuration shown in FIG. 5 along the score lines 80, 82, 84 and 86. (FIG. 2).

Figure 7:
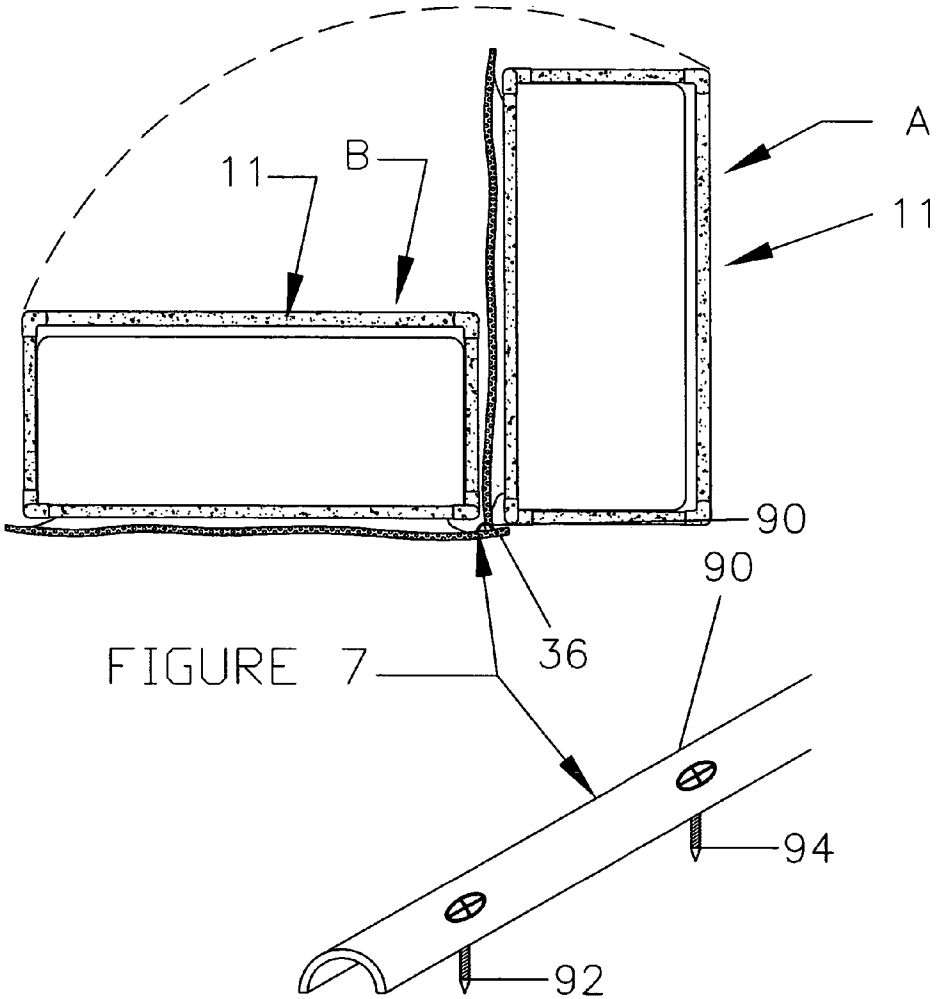
FIG. 7 illustrates an optional hinge for use with this invention.

An alternative hinge construction is shown in FIG. 7 and includes a pivot rod 90 attached by nails 92 and 94 to skirt 36 and to an attic floor to render the insulation construction 11 pivotable between position A and B.

Figure 9:
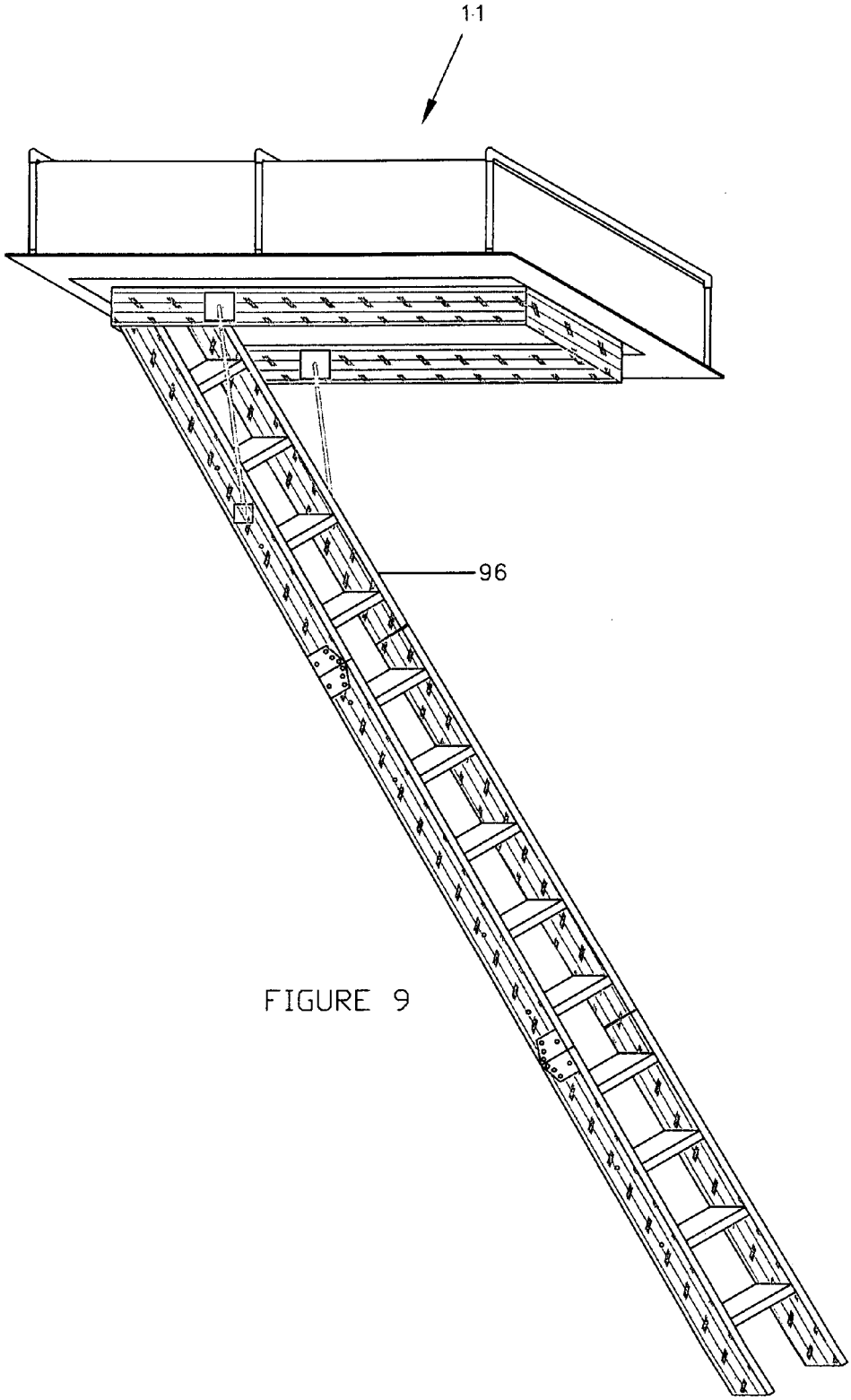
FIG. 9 is a side view of the positioned insulator construction of FIG. 1.

As shown in FIG. 9, the insulation construction 11 of this invention is positioned over a ceiling hole above a set of folding stairs 96 by strings 97, 98, 99 and 100 wound around washers 101, 102, 103 and 104. The washers can be attached to walls of a hole in a ceiling.

The invention claimed is:

1. A three dimensional insulator construction which comprises:

a substrate layer adhered to a heat insulation layer to form an insulating layer, said substrate layer having a skirt extending around a periphery of said substrate layer said insulating layer having a central rectangular or square portion, a plurality of side sections, each of said side sections being attached to only one side of said central rectangular or square portion, two of said side sections being positioned in opposing positions to each other having two wing sections attached thereto, means for securing said wing sections to a side section positioned adjacent to each of said wing sections, a rod construction having a first set of horizontal rods and a second set of horizontal rods joined by a set of vertical rods that extend through said folded blank construction insulating layer at two points, each of said first set of horizontal rods having a detachable rod section to permit folding of said substrate layer and said insulating layer while maintaining said vertical rods connected to said first set of horizontal rods and to said second set of horizontal rods when said detachable horizontal rod sections are detached from said rod construction, and said skirt extending outside of a closed structure formed by said first set of horizontal rods when said first set of horizontal rods are connected.

2. The insulator construction of claim 1 wherein said securing means comprises mating hooks and loops.

3. The insulator construction of claim 1 which includes an exposed heat reflective layer secured to said insulating layer.

4. The insulator construction of any one of claims 1, 2 or 3 which include a pivot rod attached to one of said side sections, said pivot rod being attached to an underlying support structure to permit said insulator construction to pivot about said pivot rod.

* * * * *